United States Patent [19]

Mooz et al.

[11] Patent Number: 4,617,544

[45] Date of Patent: Oct. 14, 1986

[54] HIGH VOLTAGE, HIGH RUPTURE CAPACITY FUSE

[75] Inventors: Dietrich Mooz, Krefeld; Rolf Dirks, Willich, both of Fed. Rep. of Germany

[73] Assignee: Felten & Guilleaume Energietechnik GmbH, Cologne, Fed. Rep. of Germany

[21] Appl. No.: 713,273

[22] Filed: Mar. 18, 1985

[30] Foreign Application Priority Data

Mar. 17, 1984 [DE] Fed. Rep. of Germany ..... 3409957

[51] Int. Cl.[4] ..... H01H 37/00; H01H 85/00; H01H 71/20

[52] U.S. Cl. ..... 337/3; 337/4; 337/148; 337/244

[58] Field of Search ..... 337/3, 4, 5, 6, 148, 337/150, 151, 174, 244, 267, 144, 154, 194, 79; 335/145

[56] References Cited

U.S. PATENT DOCUMENTS 2,306,153 12/1942 Biermanns et al. ..... 337/244

3,593,249 7/1971 Sedgwick ..... 337/148

*Primary Examiner*—Harold Broome

*Attorney, Agent, or Firm*—Michael J. Striker

[57] ABSTRACT

An HRC-fuse as an insulating body surrounding a main fusible conductor and an auxiliary fusible conductor connected to a spring biased impact pin. A conductive cap serving as a terminal for the fusible conductors is arranged on the insulating body and is provided with an outlet opening opposite the impact pin. A tripping hollow pin or sleeve coaxially surrounds at least a part of the impact pin and passes through the outlet opening. A bimetal release pawl is arranged in the one cap parallel to the pin and being electrically connected to the fusible conductors. The pawl engages a rest on the tripping sleeve to counteract a biasing spring. The impact pin and the tripping sleeve are triggered independently one from the other either by a short-circuit current melting the auxiliary conductor, or by an overload which heats up the bimetal release and triggers the sleeve. Both the tripping sleeve and the impact pin act on a load interruptor arranged opposite the outlet opening.

7 Claims, 3 Drawing Figures

HIGH VOLTAGE, HIGH RUPTURE CAPACITY FUSE

BACKGROUND OF THE INVENTION

The present invention relates in general to an electrical safety fuse and in particular to a high voltage, high power fuse of the type which includes a main fusible wire for interrupting a short-circuit current in an outer circuit, an auxiliary fusible wire for releasing a spring biased impact pin, an insulating body surrounding the two fusible wires and being hermetically closed at two opposite sides thereof by conductive caps, the caps acting as contact terminals for the two fusible wires.

High voltage, high power (HRC) fuses of this kind are devices for a singular interruption of short circuit currents in interior and exterior switching installations. These fuses are suitable as a short-circuit protection of voltage converters, capacitors, cable distributors, transformers and the like. They protect the series connected apparatuses and conductors against thermal and dynamic effects of excessive short-circuit currents. Current limiting fuse of this kind interrupts such currents already in the course of their increase.

The HRC-fuses serve only as a protection against short-circuit, the protection against overload is performed by other current safety devices at the secondary side (low voltage side). During the failure of these secondary sides overcurrent protecting devices or in the case of a failure of the interconnected devices such as for example distributing transformer, a hazardous gap occurs in the overall protection range inasmuch the conventional HRC-fuses cannot interrupt currents whose value is below the triple nominal value of the fuse. In order to eliminate this safety gap, the so-called full range fuses have been recently developed, all representing a combination of a HRC-fuse with an overload fuse. This known compound device, however, is very expensive.

In order to connect the distributing transformers to an intermediate voltage network, there are often used load interrupting switches in combination with HRC-fuses. The load interruption switches reliably respond to currents below the triple value of nominal value of the fuse.

SUMMARY OF THE INVENTION

A general object of the present invention is to provide an improved HRC-fuse which in addition to a short-circuit protection is provided also with an overload protection device which is capable in the event of an overcurrent to switch off also a load interrupting switch which is connected in series with the HRC-fuse.

In keeping with this object and others which will become apparent hereinafter, one feature of the present invention resides, in the provision of an HRC-fuse of the before-described kind in which at least one cap has an outlet opening, a tripping sleeve arranged in the outlet opening and surrounding the spring biased impact pin to guide the same through the outlet opening, a bimetal release arranged in the one cap and being electrically connected in series to the fusable wires, the release including a pawl normally engaging the tripping sleeve, and spring means biasing the tripping sleeve against the pawl so as to eject the tripping sleeve through the outlet opening when the bimetal release is activated and the pawl disengages the sleeve.

The advantage of this invention is in the fact that the tripping sleeve at the occurrence of an overcurrent is triggered by a simple bimetal release to strike a superposed load interrupting switch to activate the latter. In this manner overcurrents are disconnected from the load interrupting switch and HRC-fuse need not be equipped with its own switching device. Moreover, after the bimetal release cools down the tripping sleeve can be reset for a multiple use. The tripping sleeve operates independently on the spring biased impact pin. According to a first embodiment the release of the load interrupting switch is accomplished in the event of an overcurrent by the tripping sleeve and in the event of a short-circuit by the impact pin. A second embodiment of this invention provides a common releasing pin which in the case of an overcurrent responds to the bimetal release and in the case of a short-circuit triggers the impact pin. In both instances the overload protecting device is an integral part of the cap of the HRC-fuse so that the fuse fits in its holding socket without additional measures. In a preferred embodiment of the HRC-fuse of this invention, the cap enclosing the overload protecting device is insertable on a standard fuse. In this embodiment it is of advantage that the overload protecting device after melting of the fusible wires can be replaced on an intact fuse.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
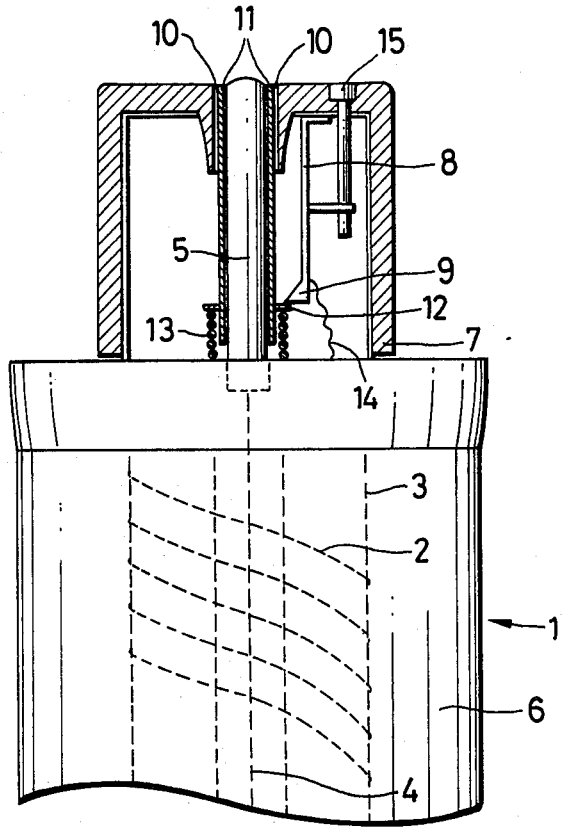
FIG. 1 is a sectional side view of a bimetal release in a cap of a standard HRC-fuse for providing separately acting tripping or impact pins activating an externally arranged load interrupter.

In the figures, there are schematically illustrated the essential component parts of a high voltage, high power (HRC) fuse 1, namely a main fusing conductor 2 and an auxiliary fusing conductor 4 connected in parallel to the main fusing conductor. The main fusing conductor consists of several parallel connected tapes which for adjusting the length necessary for the operation with a network voltage is helically wound on a ceramic support 3. The auxiliary fusing conductor as a rule is in the form of a resistance wire which is connected parallel to the main fusible conductor and extends in a central bore in the ceramic support 3. The auxiliary resistance wire 4 is spring biased and releases after its melting an interruption indicator which is in the form of an impact pin 5. The whole fuse assembly is arranged in an insulating body 6 which at both ends thereof is hermetically sealed by conductive caps 7 which are shaped to serve as contact terminals insertable in a fuse holder. In one of these caps a bimetal release 8, made of metal straps is installed. The ends of the metal straps are bent at right angles whereby one bent portion serves for the attachment to the inner surface of the top side of the cap and the other end portion serves for mounting a pawl 9. The spring biased impact pin after its release by short-circuit current strikes a non-illustrated lever which in turn opens a superposed, non-illustrated load interrupting switch. After a short-circuit, the entire fuse must be replaced.

In the range of the conductive cap 7, the impact pin 5 is surrounded by a tubular tripping pin or sleeve 11. The purpose of the tripping sleeve, after triggering in response to an overcurrent (overload) is to travel the same distance as the impact pin 5 and to perform the same function, namely to open a superposed load interrupting switch. Both pins 5 and 11 operate completely independently one from the other but as mentioned before, act in the same manner on the superposed load interrupting switch. The tripping sleeve 11 is provided near its lower end with a circumferential step or rest 12 which engages the pawl 9 on the bimetal release 8. The rest 12 is acted upon against pawl 9 by a biasing spring 13 resting on the top of the fuse body 6. The bimetal release 8 is connected by a flexible conduit 14 to the fusible conductors 2 and 4.

In the case of an overcurrent the bimetal release 8 warms up, bends toward the inner surface of the cap and the pawl 9 disengages the step 12 on the tripping sleeve 11. As a consequence the spring 13 rapidly displaces the sleeve 11 through the outlet opening 10 so that the sleeve can release the load interrupter.

An accurate adjustment of the bimetal release relative to the rest 12 is made possible within a tolerance range by the setting screw 15 which engages a projection on the bimetal strip. By adjusting the engagement range of the pawl 9, the effective current flowing the bimetal release 8 can be varied so as to match the nominal current value of the fuse.

Figure 2:
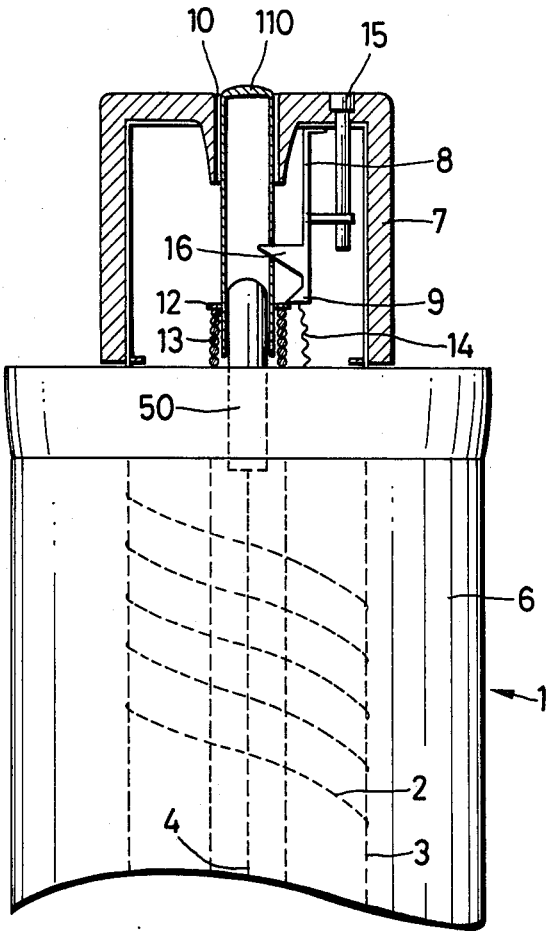
FIG. 2 is a sectional side view of a bimetal release arranged in a cap on a standard HRC-fuse provided with a compound release pin arrangement tripping outwardly in response to overload and short-circuits.

In the embodiment according to FIG. 2, there is provided a hollow tripping pin 110 whose lower part surrounds an impact pin 50. The length of the impact 50 is less than the length of the hollow tripping pin 110. The bimetal release 8 is provided with a catch 16 arranged above the pawl 9. The catch 16 projects into a recess in the hollow tripping pin 110 and has a sloping lower side which in the event of a short-circuit is acted upon by the impact pin 50. When the pin 50 is released, it displaces the catch 16 out of the recess and bends the bimetal strip 8 radially outwardly so that the pole 9 is disengaged from the rest 12 of the hollow pin 110 and the latter is ejected by the spring 13 out of the outlet opening 10. In the event of an overcurrent, the hollow tripping pin 110 is released in the same fashion as in the preceding example. In replacing the fuse it can be found out whether the impact pin 50 has been released or not.

Figure 3:
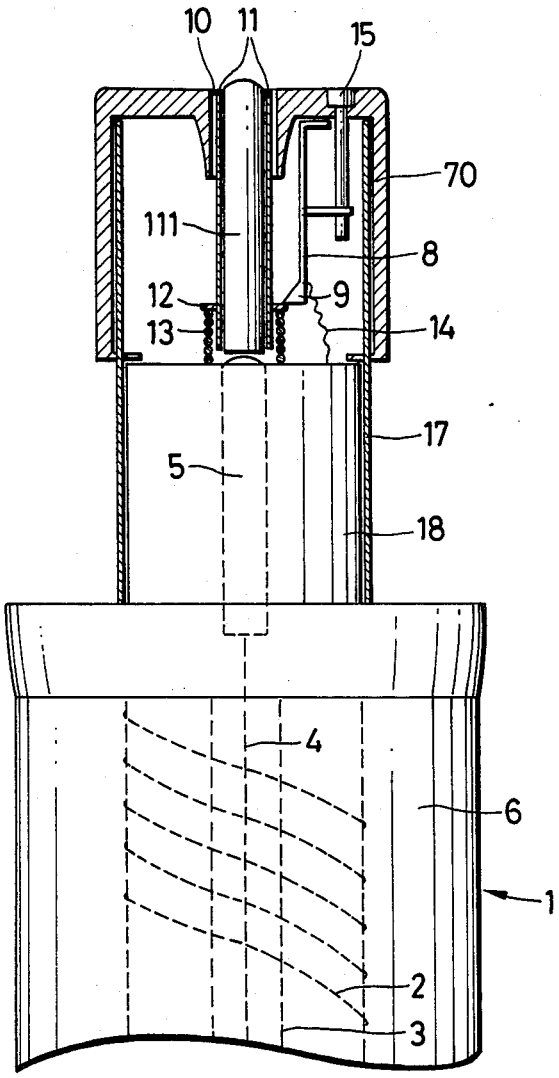
FIG. 3 is a sectional side view of the bimetal release arranged in a cap which can be plugged onto an attachment on a standard HRC-fuse having separate outwardly acting tripping elements.

FIG. 3 illustrates an embodiment in which the bimetal release 8 is arranged in a cap 70 which is constructed as a plug-in piece for a standard fuse. The plug-in piece includes an insulating tube 17 which is inserted or screwed on an attachment 18 projecting from the fuse body 6. The length of the insulating tubular piece 17 corresponds to the combined length of the attachment 18 and of the plug on cap 17. The arrangement of the tripping sleeve 11 is the same as in the embodiment of FIG. 1. The tripping sleeve 11 surrounds a solid impact pin 111 whose bottom is in contact with the axially arranged spring biased impact pin 5 operating in the same manner as in the embodiment of FIG. 1. In the event of a short-circuit, the fuse conductor 4 is melted and the impact pin 5 ejects the solid impact pin 111 out of the outlet opening 10. In the case of an overcurrent only the tripping 11 is released by the bimetal strip 8.

It will be understood that each of the elements described above, or two or more together, may also find a useful application in other types of constructions differing from the types described above.

While the invention has been illustrated and described as embodied in specific examples of an HRC-fuse for use in connection with a load interruptor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A high voltage, high rupture capacity fuse comprising a main fusible conductor for interrupting a short-circuit current in an outer circuit, an auxiliary fusible conductor for releasing a spring biased impact pin, an insulating body surrounding the two fusible conductors and being hermetically closed at two opposite sides thereof by conductive caps, the caps acting as contact terminals for the two fusible conductors, at least one cap having an outlet opening opposite said impact pin, a tripping sleeve arranged in said outlet opening and surrounding said impact pin to guide the same through said outlet opening, a bimetal release arranged in said one cap and being electrically connected to said fusible conductors, said bimetal release including a pawl normally engaging said sleeve, and spring means biasing said tripping sleeve against said pawl so as to eject said tripping sleeve through said outlet opening against a load interrupter when an overcurrent activates said bimetal release and said pawl disengages said sleeve.

2. A high voltage, high rupture capacity fuse comprising a main fusible conductor for interrupting a short-circuit current in an outer circuit, an auxiliary fusible conductor for releasing a spring biased impact pin, an insulating body surrounding the two fusible conductors and being hermetically closed at two opposite sides thereof by conductive caps, said caps acting as contact terminals for the two fusible conductors, at least one cap having an outlet opening opposite said impact pin, a hollow tripping pin arranged in said outlet opening and surrounding at its lower end said impact pin to guide the same toward said outlet opening, a bimetal release arranged in said one cap, said release including a pawl normally engaging said hollow tripping pin and a catch normally passing through a recess in the jacket of said hollow tripping pin above the tip of said impact pin, and spring means biasing said hollow tripping pin against said pawl and toward said outlet opening so that in the event of an overcurrent said bimetal release disengages said pawl and said catch from said hollow tripping pin and releases the latter whereas in the event of a short-circuit current said impact pin displaces radially outwardly said catch, thus releasing said hollow tripping pin.

3. A high voltage, high rupture capacity fuse as defined in claim 1, wherein said bimetal release includes a bimetal strip secured at the upper end thereof to the top inner surface of said one cap and being provided at its free end with said pawl, said tripping sleeve being provided on its jacket with a circumferential step whose lower surface is in contact with a helical spring resting on said insulating body and said pawl engaging in compressed condition of said spring the upper surface of said circumferential step.

4. A high voltage, high rupture capacity fuse as defined in claim 2, wherein said catch has a sloping lower surface cooperating with the tip of said impact pin so as to displace said bimetal release and said pawl radially outwardly.

5. A high voltage, high rupture capacity fuse as defined in claim 1, comprising a setting screw mounted on said one cap and engaging said bimetal release to adjust the engagement of said pawl with said tripping sleeve.

6. A high voltage, high rupture capacity fuse as defined in claim 1, wherein said insulating body is formed with an axial attachment, and further comprising an insulating tubular piece whose lower part inserted on said attachment, said one cap being inserted on the upper part of said insulating tubular piece, and said impact pin including an upper segment passing through said tripping sleeve and a lower segment passing through said attachment in alignment with said upper segment and being connected to said auxiliary fusible conductor.

7. A high voltage, high rupture capacity fuse as defined in claim 1, wherein said one cap together with the bimetal release is disconnectably attached through said insulating body so as to be reused in connection with different fuses.

* * * * *